US011126133B1

(12) United States Patent
Saiki et al.

(10) Patent No.: US 11,126,133 B1
(45) Date of Patent: Sep. 21, 2021

(54) POWDER COLLECTION DEVICE AND IMAGE FORMING APPARATUS

(71) Applicant: FUJIFILM BUSINESS INNOVATION CORP., Tokyo (JP)

(72) Inventors: Atsuna Saiki, Kanagawa (JP); Go Miura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/925,360

(22) Filed: Jul. 10, 2020

(30) Foreign Application Priority Data

Mar. 12, 2020 (JP) ..... JP2020-042556

(51) Int. Cl.
*G03G 21/10* (2006.01)
*G03G 21/12* (2006.01)

(52) U.S. Cl.
CPC ..... *G03G 21/105* (2013.01); *G03G 21/12* (2013.01)

(58) Field of Classification Search
CPC ..... G03G 21/105; G03G 21/12
See application file for complete search history.

(56) References Cited

U.S. PATENT DOCUMENTS

2005/0058475 A1* 3/2005 Tsurusaki ..... G03G 21/105 399/358
2008/0075483 A1* 3/2008 Bito ..... G03G 21/105 399/35
2010/0080580 A1* 4/2010 Yamaguchi ..... G03G 21/12 399/35
2010/0080638 A1 4/2010 Ichikawa et al.
2014/0161474 A1* 6/2014 Oda ..... G03G 21/105 399/35

FOREIGN PATENT DOCUMENTS

JP H11-119622 A 4/1999
JP 2010-078957 A 4/2010

* cited by examiner

*Primary Examiner* — Sandra Brase
(74) *Attorney, Agent, or Firm* — Oliff PLC

(57) ABSTRACT

A powder collection device includes a transport path, plural collection containers, and an opening and closing body. The transport path is configured to receive powder discharged from an image forming unit and transport the powder to discharge ports. The collection containers are arranged on the same straight line along the transport path. The collection containers is configured to accommodate the powder transported by the transport path. The opening and closing body has plural openings. The opening and closing body is configured to slide in the transport path so as to cause the transport path and the collection containers to sequentially communicate with each other.

16 Claims, 11 Drawing Sheets

POWDER COLLECTION DEVICE AND IMAGE FORMING APPARATUS

CROSS-REFERENCE TO RELATED APPLICATIONS

This application is based on and claims priority under 35 USC 119 from Japanese Patent Application No. 2020-042556 filed Mar. 12, 2020.

BACKGROUND

1. Technical Field

The present disclosure relates to a powder collection device and an image forming apparatus.

2. Related Art

JP-A-2010-78957 discloses an image forming apparatus including an image forming unit, a first accommodating unit, a second accommodating unit, a transport path, a first discharge unit, a second discharge unit, a transport unit, a supply unit, and a controller. The image forming unit forms an image on a recording material. The first accommodating unit accommodates waste powder discarded from the image forming unit. The second accommodating unit accommodates waste powder discharged from the image forming unit. The waste powder is transported on the transport path. The first discharge unit is provided on the transport path. The first discharge unit discharges the waste powder, which is transported on the transport path, to the first accommodating unit. The second discharge unit is provided on the transport path. The second discharge unit discharges the waste powder, which is transported on the transport path, to the second accommodating unit. The transport unit is provided along the transport path from the first discharge unit to the second discharge unit. The transport unit transports the waste powder in the transport path toward the second discharge unit in a first operation state. The transport unit transports the waste powder in the transport path toward the first discharge unit in a second operation state. The supply unit supplies the waste powder from the image forming unit to a position on the transport path between the first discharge unit and the second discharge unit. The controller causes the transport unit to operate in the first operation state and in the second operation state. When the transport unit is switched from the first operation state to the second operation state to switch a transport direction of the waste powder, the controller stops the supply unit or decreases an output of the supply unit.

JP-A-11-119622 discloses a waste toner collection mechanism of an image forming apparatus. The waste toner collection mechanism collects a waste toner generated in an electrophotographic image forming process. The waste toner collection mechanism includes a transport path and plural waste toner collection units. One end of the transport path is connected to a waste toner collection source of the electrophotographic image forming process. The waste toner collection units are detachably connected to another end of the transport path.

SUMMARY

Aspects of non-limiting embodiments of the present disclosure relate to providing a powder collection device and an image forming apparatus that can reduce the frequency of replacement work of a collection container.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder collection device including a transport path, plural collection containers, and an opening and closing body. The transport path is configured to receive powder discharged from an image forming unit and transport the powder to discharge ports. The collection containers are arranged on the same straight line along the transport path. The collection containers are configured to accommodate the powder transported by the transport path. The opening and closing body has plural openings. The opening and closing body is configured to slide in the transport path so as to cause the transport path and the collection containers to sequentially communicate with each other.

BRIEF DESCRIPTION OF THE DRAWINGS

Exemplary embodiment(s) of the present disclosure will be described in detail based on the following figures, wherein.

DETAILED DESCRIPTION

Figure 1:
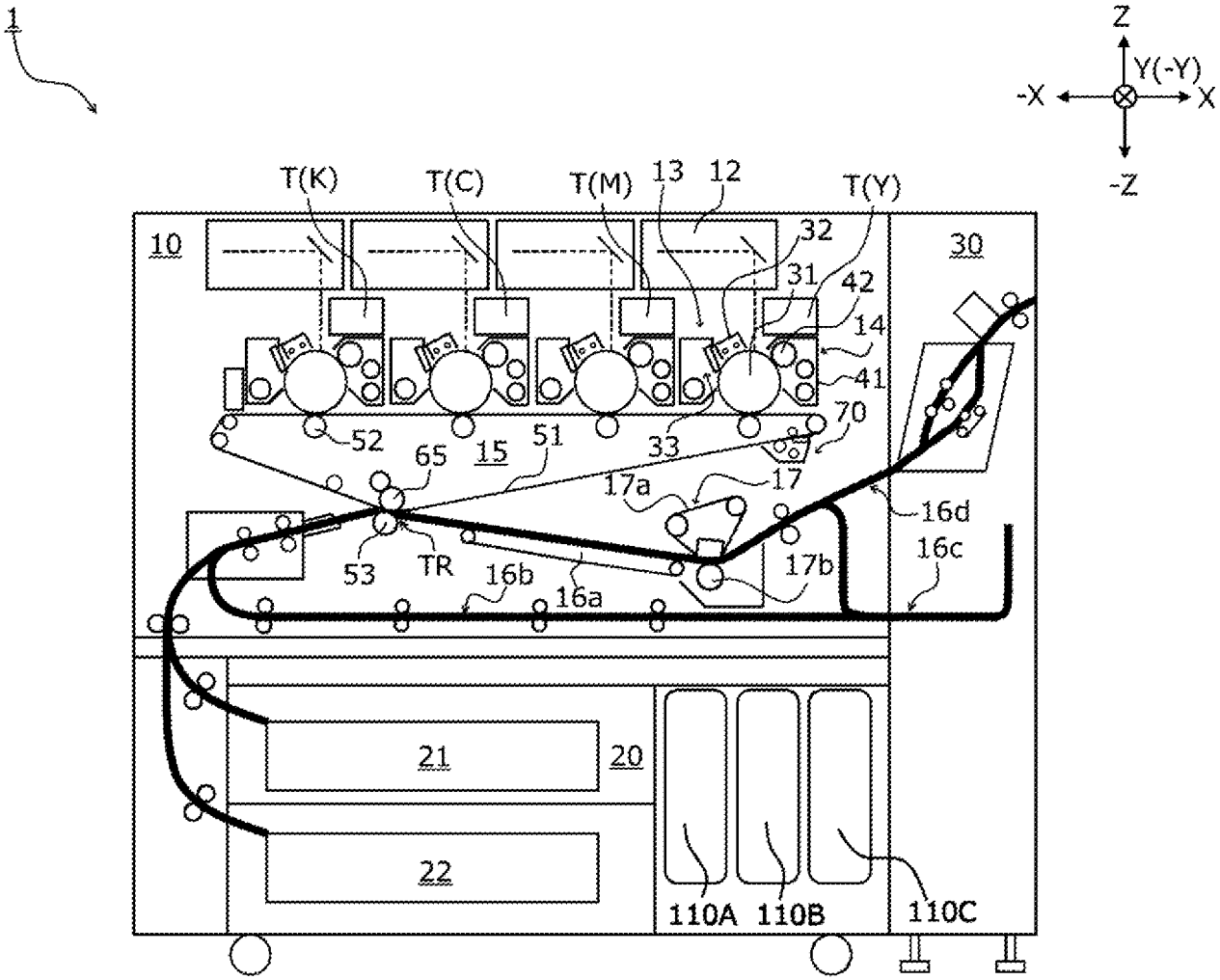
FIG. 1 is a schematic cross-sectional view illustrating an example of a schematic configuration of an image forming apparatus.

Next, an exemplary embodiment and an example will be described in more detail with reference to the accompanying drawings. It is noted that the present disclosure is not limited to the exemplary embodiment and the example.

It is also noted that in the following description made with reference to the accompanying drawings, the drawings are schematic and ratios of dimensions or the like of elements are different from actual ones. Illustration of elements and members other than those necessary for the description may be omitted as appropriate for the sake of easy understanding.

In order to facilitate understanding of the following description, front and rear directions will be referred to as an "X direction" and a "−X direction", left and right directions will be referred to as a "Y direction" and a "−Y direction", and up and down directions will be referred to as a "Z direction" and a "−Z direction" in the drawings.

(1) Overall Configuration and Operation of Image Forming Apparatus (1.1) Overall Configuration of Image Forming Apparatus FIG. 1 is a schematic cross-sectional view illustrating an example of a schematic configuration of an image forming apparatus 1 according to this exemplary embodiment.

The image forming apparatus 1 includes an image forming device 10, a sheet feeding device 20 mounted below the image forming device 10, and a sheet discharge unit 30 provided at one end of the image forming device 10. A printed sheet is discharged to the sheet discharge unit 30.

The image forming device 10 includes a system control device (not illustrated), exposure devices 12, photoconductor units 13, developing devices 14, a transfer device 15, sheet transport devices 16*a*, 16*b*, 16*c*, 16*d*, and a fixing device 17. The image forming device 10 forms a toner image on a recording medium fed from the sheet feeding device 20. The photoconductor unit 13 and the developing device 14 may serve as an image forming unit.

The sheet feeding device 20 supplies a recording medium to the image forming device 10. That is, the sheet feeding device 20 includes plural sheet loading units 21, 22 that accommodate recoding media of different types (for example, different materials, thicknesses, sheet sizes, or grain sizes). The sheet feeding device 20 supplies the sheet fed out from any one of the sheet loading units 21, 22 to the image forming device 10.

The sheet discharge unit 30 discharges the recording medium on which an image is formed by the image forming device 10. For this purpose, the sheet discharge unit 30 includes a discharged sheet accommodating unit. The recording medium on which the image is formed is discharged to the discharged sheet accommodating unit. The sheet discharge unit 30 may have a function of performing post-processing such as cutting or stapling (needle binding) on a sheet bundle output from the image forming device 10.

(1.2) Configuration and Operation of Image Forming Device

In the image forming apparatus 1 having the configuration described above, the recording medium which is fed out from one of the sheet loading units 21, 22 designated by a print job for each recording medium to be printed is sent to the image forming device 10 in accordance with timing of image formation.

Photoconductor units 13 (Y, M, C, K) are arranged below the exposure device 12 side by side. Hereinafter, when it is not necessary to distinguish the photoconductor units 13Y, 13M, 13C, 13K from each other, they are simply referred to as the photoconductor units 13. Each photoconductor unit 13 includes a photoconductor drum 31 that is driven to rotate. A charger 32, the exposure device 12, the developing device 14, a primary transfer roller 52, and a cleaning device 33 are arranged along a rotation direction of the photoconductor drum 31.

The developing device 14 includes a developing housing 41 that contains a developer therein. A developing roller 42 is disposed in the developing housing 41. The developing roller 42 faces the photoconductor drum 31. A developer having a regulated layer thickness is supplied to the developing roller 42 to form a toner image on the photoconductor drum 31.

The developing devices 14Y, 14M, 14C, 14K have substantially the same configuration except developers contained in the developing housings 41. The developing devices 14Y, 14M, 14C, 14K form toner images of yellow (Y), magenta (M), cyan (C), and black (K), respectively. Hereinafter, when it is not necessary to distinguish the developing devices 14Y, 14M, 14C, 14K from each other, they are simply referred to as the developing devices 14.

A replaceable toner cartridge T accommodating the developer (that is, the toner containing a carrier) is mounted above the developing device 14. A toner cartridge guide (not illustrated) is provided that supplies the developer from each toner cartridge T (Y, M, C, K) to a respective one of the developing devices 14.

The surface of the rotating photoconductor drum 31 is charged by the charger 32. An electrostatic latent image is formed on the surface of the photoconductor drum 31 by latent image formation light emitted from the exposure device 12. The electrostatic latent image formed on the photoconductor drum 31 is developed into the toner image by the developing roller 42.

The transfer device 15 includes an intermediate transfer belt 51, the primary transfer rollers 52, and a secondary transfer roller 53. The toner images of the respective colors formed on the photoconductor drums 31 of the photoconductor units 13 are transferred onto the intermediate transfer belt 51 in a superimposed manner. The intermediate transfer belt 51 may serve as an image carrier. The primary transfer rollers 52 sequentially transfer (primarily transfer) the toner images of the respective colors formed by the photoconductor units 13 onto the intermediate transfer belt 51. The secondary transfer roller 53 collectively transfers (secondarily transfers) the toner images of the respective colors, which are transferred onto the intermediate transfer belt 51 in the superimposed manner, onto the recording medium.

The toner images of the respective colors formed on the photoconductor drums 31 of the photoconductor units 13 are sequentially electrostatically transferred (primarily transferred) onto the intermediate transfer belt 51 by the primary transfer rollers 52 to which a predetermined transfer voltage is applied from a power supply device (not illustrated) that is controlled by the system control device, so that a superimposed toner image is formed in which the toner images of the respective colors are superimposed.

As the intermediate transfer belt 51 moves, the superimposed toner image on the intermediate transfer belt 51 is transported to a secondary transfer portion TR. In the secondary transfer portion TR, the secondary transfer roller 53 is in pressure contact with a backup roller 65 via the intermediate transfer belt 51.

When the superimposed toner image is transported to the secondary transfer portion TR, the recording medium is supplied from the sheet feeding device 20 to the secondary transfer portion TR according to timing of the transport of the superimposed toner image. A predetermined secondary transfer voltage is applied from the power supply device controlled by the system control device to the backup roller 65 which faces the secondary transfer roller 53 via the intermediate transfer belt 51, so that the superimposed toner images on the intermediate transfer belt 51 are collectively transferred onto the recording medium.

A residual toner on the surface of the photoconductor drum 31 after the primary transfer is removed by the cleaning device 33 as a waste toner. The residual toner on the intermediate transfer belt 51 after the transfer of the superimposed toner images is also removed by a belt cleaning device 70 as a waste toner. The waste toners removed by the cleaning device 33 and the belt cleaning device 70 is transported to plural collection containers 110 detachably provided in an apparatus main body. In the present exemplary embodiment, the waste toner removed by the cleaning device 33 and the belt cleaning device 70, a surplus developer discharged from the developing device 14, and the like will be referred to as "powder", particularly "waste powder".

The fixing device 17 includes an endless fixing belt 17*a* and a pressure roller 17*b*. The fixing belt 17*a* rotates in one direction. The pressure roller 17*b* is in contact with a circumferential surface of the fixing belt 17*a* and rotates in one direction. A fixing region is formed by the pressure contact between the fixing belt 17*a* and the pressure roller 17*b*.

The recording medium to which the toner image is transferred by the transfer device 15 is transported to the fixing region of the fixing device 17 through the sheet transport device 16*a* with the toner image being unfixed to the recording medium. The toner image is fixed to the recording medium transported to the fixing device 17 by an action of heating and pressurizing by the pair of the fixing belt 17*a* and the pressure roller 17*b*.

The recording medium on which the fixing is completed is sent to the sheet discharge unit 30 through the sheet transport device 16*d*.

When images are formed on both surfaces of the recording medium, the recording medium is reversed by the sheet transport device 16*c*, and is fed again to the secondary transfer portion TR in the image forming device 10. After the toner image is transferred and the transferred image is fixed to the recording medium, the recording medium is sent to the sheet discharge unit 30. The recording medium sent to the sheet discharge unit 30 is subjected to the post-processing such as cutting and stapling (that is, needle binding) as necessary, and then discharged to the discharged sheet accommodating unit.

(2) Powder Collection Device

Figure 2:
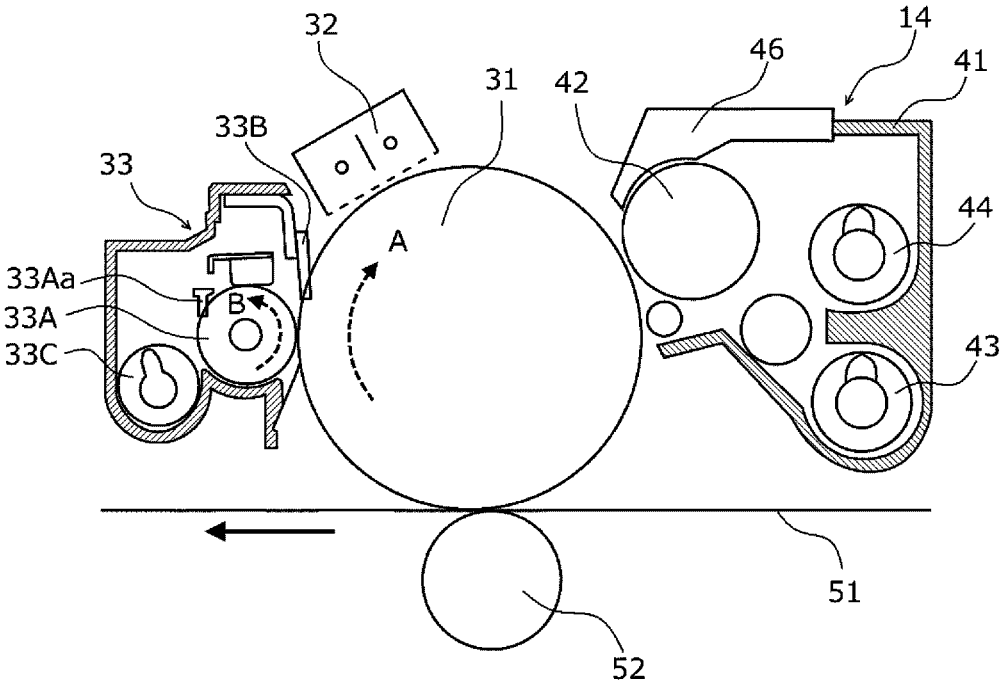
FIG. 2 is a diagram illustrating a configuration of a photoconductor unit and a developing device.
Figure 3:
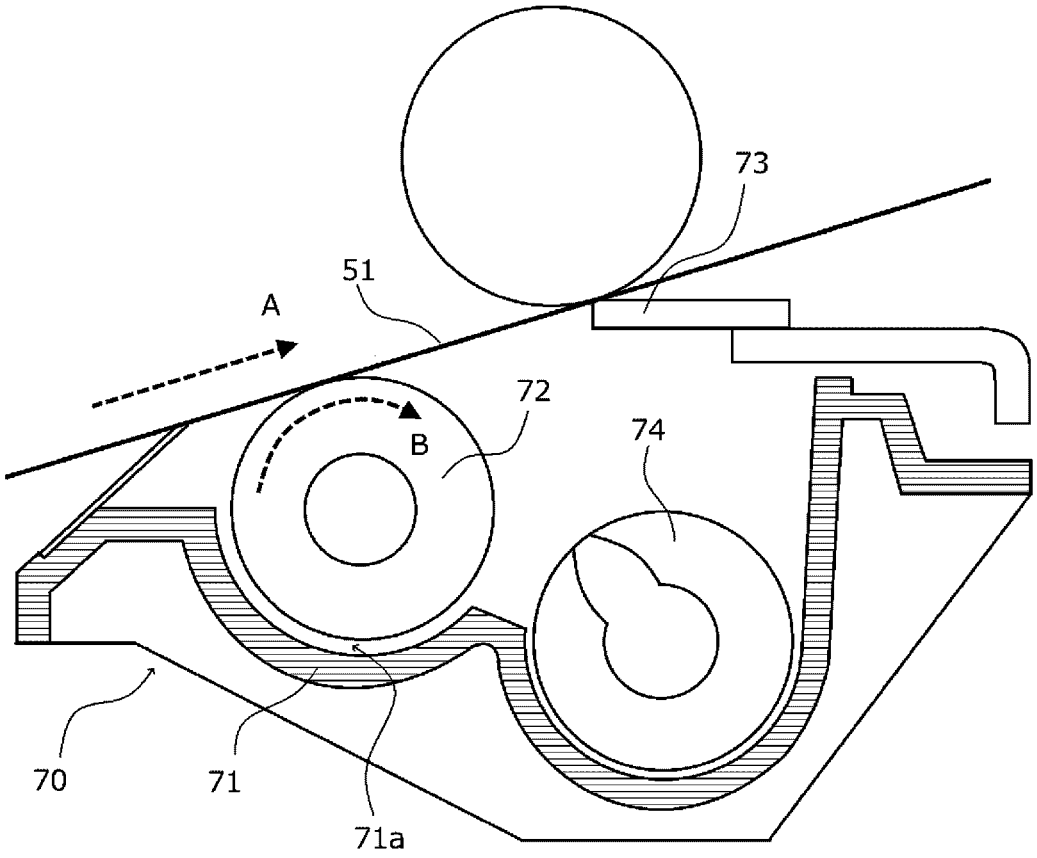
FIG. 3 is a schematic cross-sectional view illustrating a configuration of a belt cleaning device.
Figure 4:
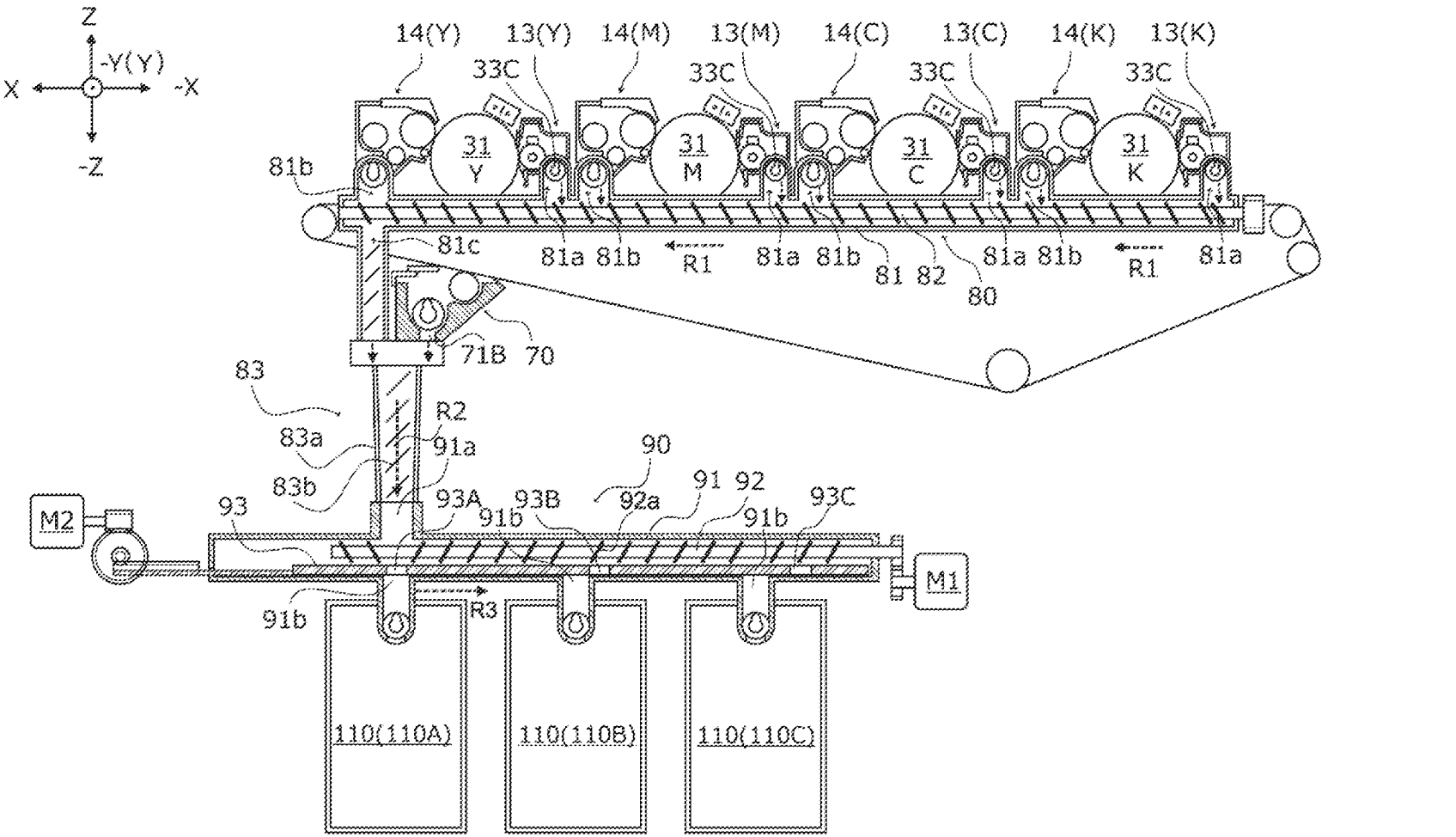
FIG. 4 illustrates the overall configuration of a powder collection device.
Figure 5:
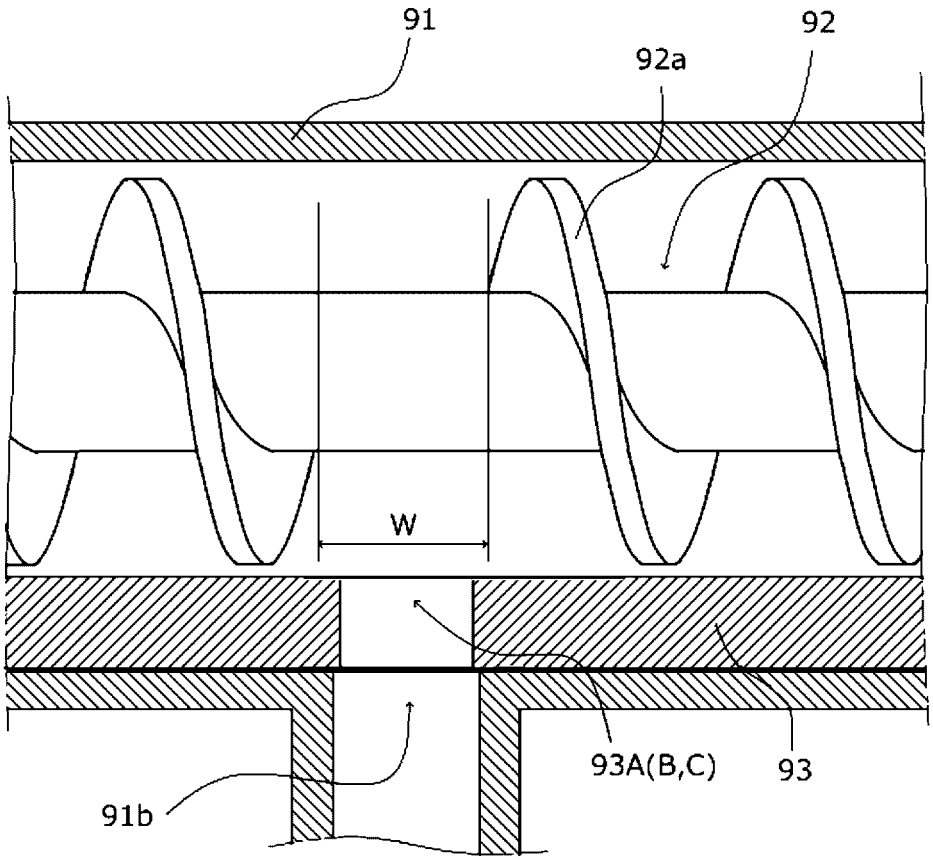
FIG. 5 illustrates a configuration of a spiral blade of a transport auger.
Figure 6:
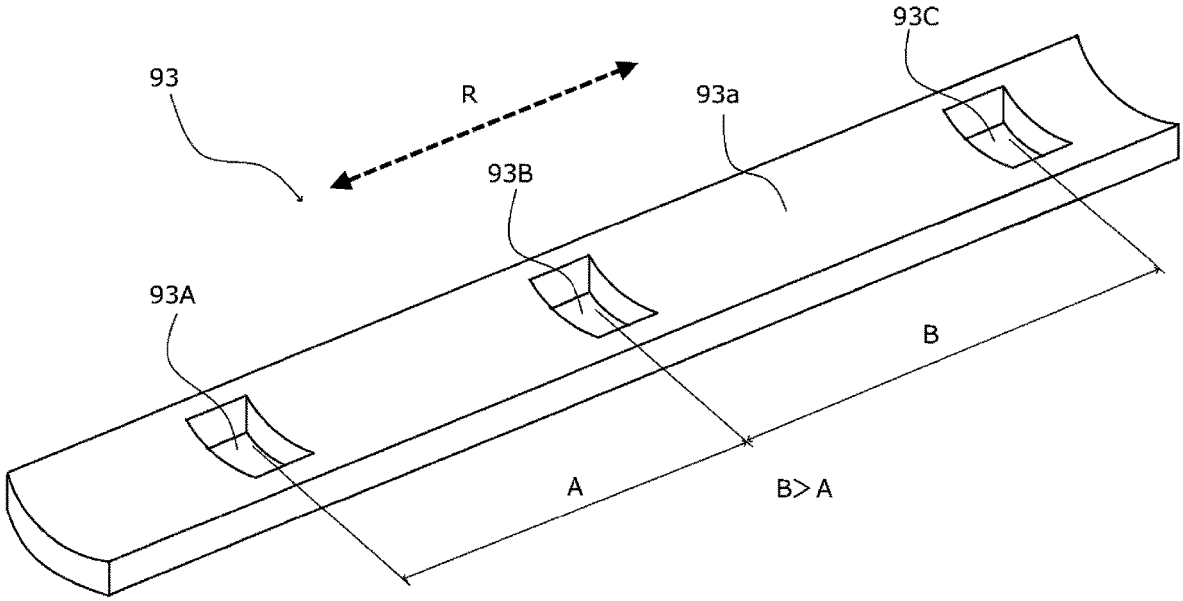
FIG. 6 is a perspective view illustrating an opening and closing body.
Figure 7A:
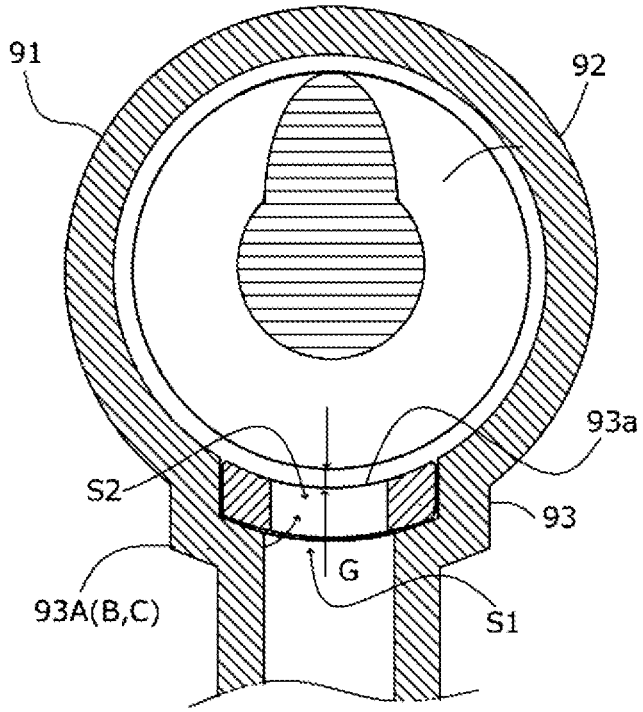
FIGS. 7A and 7B illustrate the opening area of a discharge port of a transport conduit and the opening area of an opening of the opening and closing body.
Figure 7B:
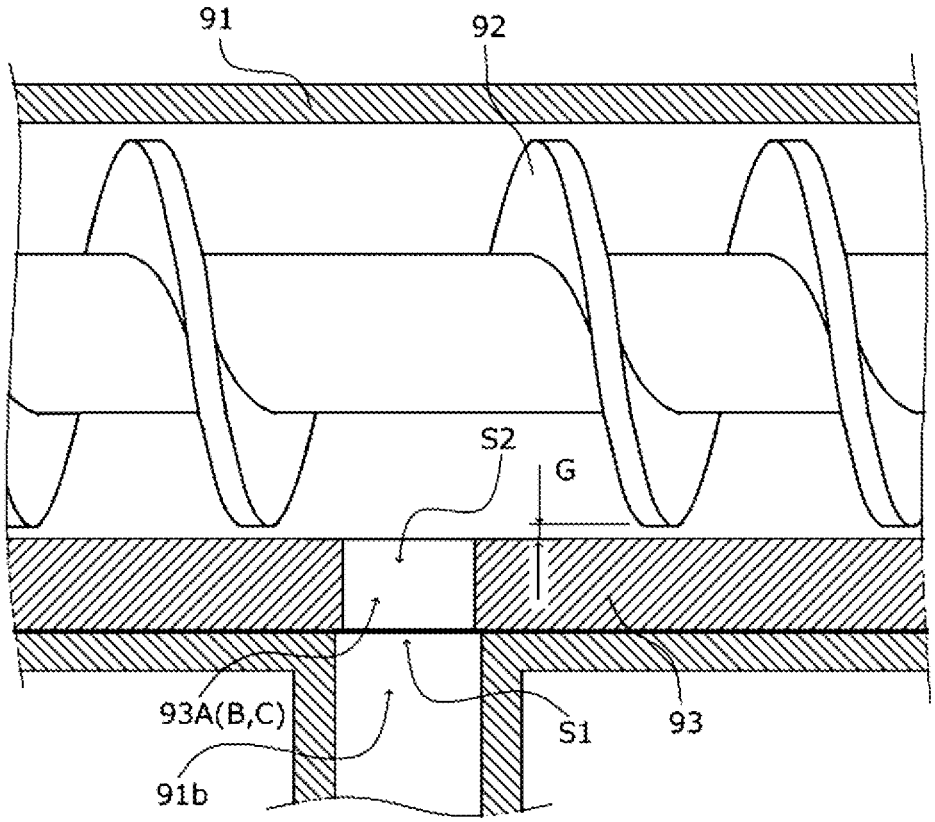
Figure 8:
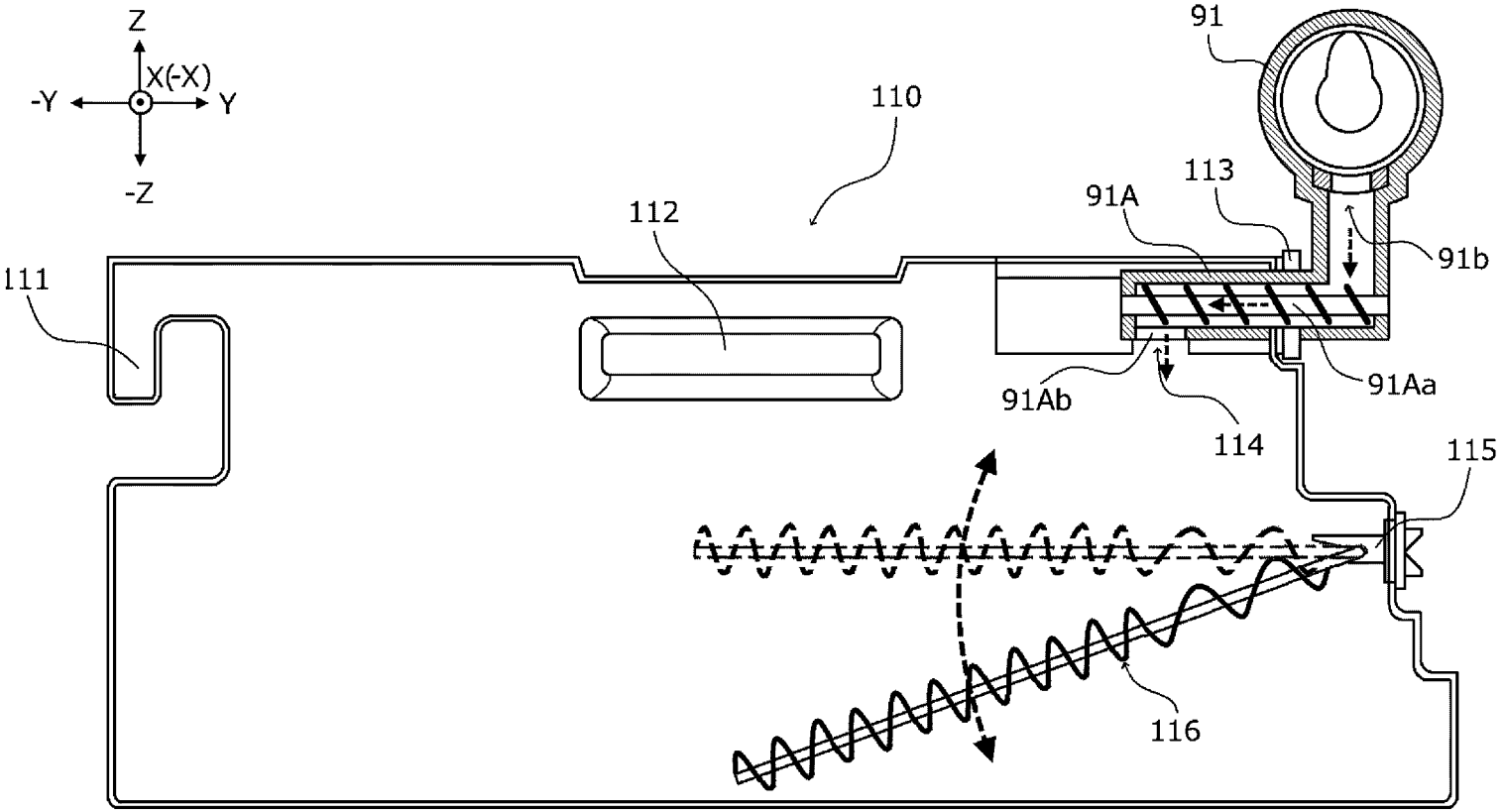
FIG. 8 illustrates collection of waste powder in a collection container.

FIG. 2 is a diagram illustrating configurations of the photoconductor unit 13 and the developing device 14. FIG. 3 is a schematic cross-sectional view illustrating a configuration of the belt cleaning device 70. FIG. 4 illustrates the overall configuration of a powder collection device 100. FIG. 5 illustrates a configuration of a spiral blade 92*a* of a transport auger 92. FIG. 6 is a perspective view illustrating an opening and closing body 93. FIGS. 7A and 7B illustrate the opening area of a discharge port 91*b* of a transport conduit 91 and the opening area of an opening 93A, 93B, 93C of the opening and closing body 93. FIG. 8 illustrates collection of the waste powder in the collection container 110.

Hereinafter, configurations of a powder collection path and the powder collection device 100 in the image forming apparatus 1 will be described with reference to the drawings.

(2.1) Discharge of Waste Toner and Waste Developer

The cleaning device 33 of the photoconductor unit 13 illustrated in FIG. 2 removes the residual toner on the photoconductor drum 31 after the toner image has been primarily transferred from the photoconductor drum 31 onto the intermediate transfer belt 51. In addition to the toner and an external additive, the residual toner contains foreign matters such as paper dust adhering to the photoconductor drum 31 from the recording medium.

A cleaning brush 33A rotates counterclockwise as indicated by an arrow B in FIG. 2 with being in contact with the surface of the photoconductor drum 31, so as to raise the residual toner on the photoconductor drum 31, which facilitates removal of the residual toner. The photoconductor drum 31 rotates clockwise as indicated by an arrow A in FIG. 2.

A cleaning blade 33B scrapes and removes the residual toner on the photoconductor drum 31 which is raised by the cleaning brush 33A.

A collection auger 33C is provided in a lower portion of the cleaning device 33. The collection auger 33C rotates to transport (i) the residual toner removed by the cleaning blade 33B and (ii) the residual toner which is removed from the cleaning brush 33A by a flicker bar 33Aa and accommodated in the cleaning device 33, to the outside of the cleaning device 33 (specifically, a first transport unit 80 (see FIG. 4)) along a rotation shaft of the collection auger 33C.

In the developing device 14, the developer (that is, the toner containing the carrier) supplied into the developing housing 41 is agitated in the developing housing 41 by an agitation auger 43, and is transported to the developing roller 42 by a supply auger 44. Then, a part of the developer is finally discharged as waste powder (hereinafter, simply referred to as a "developer") to the outside of the developing device 14 (specifically, the first transport unit 80 (see FIG. 4)).

As described above, a new developer is supplied into the developing housing 41 while the surplus developer is discharged, so that development is performed using the newly supplied developer without continuously using the developer containing the deteriorated carrier.

(2.2) Collection of Waste Toner from Transfer Device

The intermediate transfer belt 51 of the transfer device 15 includes a belt cleaning device 70 downstream of the secondary transfer portion TR in a moving direction of the intermediate transfer belt 51.

As illustrated in FIG. 3, the belt cleaning device 70 includes a housing 71, a cleaning brush 72, a cleaning blade 73, and a transport auger 74. The belt cleaning device 70 collects untransferred toner that remains on the intermediate transfer belt 51 after the secondary transfer, from the intermediate transfer belt 51.

The cleaning brush 72 rotates clockwise as indicated by an arrow B in FIG. 3 with being in contact with the surface of the intermediate transfer belt 51, so as to raise the residual toner on the intermediate transfer belt 51, which facilitates removal of the residual toner (including paper dust and the lie). The intermediate transfer belt 51 moves as indicated by an arrow A in FIG. 3.

The cleaning blade 73 scrapes and removes the residual toner on the intermediate transfer belt 51 which is raised by the cleaning brush 72.

A transport path 71*a* is formed in the housing 71. The transport path 71*a* extends in a direction (that is, the Y direction) from a front side to a rear side of the apparatus main body. This direction intersects the moving direction of the intermediate transfer belt 51. The transport auger 74 is disposed in the transport path 71*a*.

The transport auger 74 transports the residual toner removed from the intermediate transfer belt 51 by the cleaning brush 72 and the cleaning blade 73 toward a fall path 83 (which will be described later).

(2.3) Powder Collection Device

The powder collection device 100 is provided on the rear side of the image forming apparatus 1. The powder collection device 100 collects the waste powder collected from the photoconductor unit 13, the developing device 14, and the transfer device 15. The powder collection device 100 includes the first transport unit 80, a second transport unit 90, and the collection containers 110. The first transport unit

80 transports the waste powder collected from the photoconductor unit 13, the developing device 14, and the transfer device 15. The second transport unit 90 transports the waste powder transported by the first transport unit 80. The collection containers 110 accommodate the waste powder transported by the second transport unit 90 as a collected matter.

The first transport unit 80 extends horizontally (that is, in the X direction) along the photoconductor units 13 (Y, M, C, K) and the developing devices 14 (Y, M, C, K) which are arranged along the intermediate transfer belt 51.

The first transport unit 80 includes a transport conduit 81 and a transport auger 82. The overall transport conduit 81 is hollow. The transport conduit 81 accommodates the waste powder therein. The transport auger 82 transports the waste powder.

The transport conduit 81 includes receiving ports 81*a* and receiving ports 81*b*. The transport conduit 81 receives the waste toner discharged from the collection augers 33C (Y, M, C, K) of the photoconductor units 13 (Y, M, C, K) through the receiving ports 81*a*. The transport conduit 81 receives the developer from the developing devices 14 (Y, M, C, K) through the receiving ports 81*b*.

The transport auger 82 includes a spiral blade around a rotation shaft thereof. Upon receipt of a rotational force from a drive source (not illustrated), the transport auger 82 rotates along the inner wall of the transport conduit 81, thereby transporting the waste powder received through receiving ports 81*a*, 81*b* in the transport conduit 81 in the X direction (see an arrow R1 in FIG. 4).

Upon reaching a discharge port 81*c*, the waste powder transported by the transport auger 82 in the transport conduit 81 falls into the fall path 83.

The fall path 83 includes a tubular member 83*a*, an agitator 83*b*, and a drive source (not illustrated). The agitator 83*b* moves back and forth so as to vibrate in the up and down directions in the internal space of the tubular member 83*a* and breaks up the waste powder adhering to an inner wall thereof. The drive source (not illustrated) transmits a driving force for moving the agitator 83*b* back and forth. The fall path 83 is substantially perpendicular to the discharge port 81*c* of the first transport unit 80 and a discharge port 71B of the belt cleaning device 70.

The waste powder received from the first transport unit 80 and the belt cleaning device 70 falls in the fall path 83 toward the second transport unit 90 while being agitated by the agitator 83*b* (see an arrow R2 in FIG. 4).

The second transport unit 90 includes the transport conduit 91, the transport auger 92, and the opening and closing body 93. The overall transport conduit 91 is hollow. The transport conduit 91 accommodates the waste powder therein. The transport conduit 91 may serve as a transport path. The transport auger 92 transports the waste powder. The opening and closing body 93 has the openings 93A, 93B, and 93C.

The transport conduit 91 includes a receiving port 91*a* and the discharge ports 91*b*. The transport conduit 91 receives the waste powder from the fall path 83 through the receiving port 91*a*. The waste powder in the transport conduit 91 is caused to fall toward delivery ports 114 (see FIG. 8) of the collection containers 110 through the discharge ports 91.

The transport auger 92 includes the spiral blade 92*a* around a rotation shaft thereof. Upon receipt of a rotational force from a drive source M1, the transport auger 92 rotates along the inner wall of the transport conduit 91, thereby transporting the waste powder received through receiving port 91*a* in the transport conduit 91 in the −X direction (see an arrow R3 in FIG. 4).

As illustrated in FIG. 5, the transport auger 92 includes no spiral blades 92*a* in regions (indicated by W in FIG. 5) corresponding to the discharge ports 91*b* of the transport conduit 91. With this configuration, upon reaching any one of the openings 93A, 93B, 93C of the opening and closing body 93, the waste powder transported by the transport auger 92 in the transport conduit 91 falls into a corresponding one of the collection containers 110 via a corresponding one of the discharge ports 91*b* formed in the transport conduit 91.

As illustrated in FIG. 6, the overall opening and closing body 93 has a plate shape. The opening and closing body 93 has the plural (three in this exemplary embodiment) openings 93A, 93B, 93C along a longitudinal direction of the opening and closing body 93. The openings 93A, 93B, 93C pass through the opening and closing body 93 in a thickness direction of the opening and closing body 93.

The openings 93B, 93C are arranged such that a distance between the opening 93B and the opening 93C is larger than a distance between the opening 93A on a base end side and the opening 93B (B>A in FIG. 6). With this configuration, by sliding the opening and closing body 93, the openings 93B, 93C sequentially communicate with the discharge ports 91*b* of the transport conduit 91 and the delivery ports 114 of the collection containers 110.

As illustrated in FIG. 7A, an inner surface 93*a* of the opening and closing body 93 is formed in a round shape in a cross-sectional view such that the inner surface 93*a* forms a part of the inner surface of the transport conduit 91 and a gap G between the inner surface 93*a* and the transport auger 92 is substantially constant. With this configuration, the waste powder can be reliably transported toward the openings 93B, 93C in the transport conduit 91.

As illustrated in FIGS. 7A and 7B, the opening areas S1 of the discharge ports 91*b* of the transport conduit 91 are larger than the opening areas S2 of the openings 93A, 93B, 93C of the opening and closing body 93. With this configuration, when the opening and closing body 93 slides and any of the openings 93B, 93C communicates with a corresponding one of the discharge ports 91*b* of the transport conduit 91, the waste powder can be reliably caused to fall toward the collection container 110.

As illustrated in FIG. 4, the plural collection containers 110 are arranged on the same straight line along the transport direction of the waste powder in the transport conduit 91. As illustrated in FIG. 8, each collection container 110 is a box-shaped container. A handle 111 protrudes from the front side (the −Y direction) of the collection container 110. The handle 111 is used for attaching and detaching the collection container 110 to and from the apparatus main body (see FIG. 1). A handle (recess) 112 is formed in an upper center portion of the collection container 110. The handle 112 facilitates carrying the collection container 110.

An insertion port 113 is formed at an upper portion on a rear side surface (the Y direction) of the collection container 110. A transport pipe 91A provided below the transport conduit 91 of the second transport unit 90 can be inserted into the insertion port 113. A rotatable transport auger 91Aa is provided in the transport pipe 91A. The transport auger 91Aa transports the waste powder falling through the discharge port 91*b* of the transport conduit 91, to the collection container 110. A discharge port 91Ab is provided at a lower portion of an end portion of the transport pipe 91A. The transported waste powder is discharged through the discharge portion 91Ab. The delivery port 114 is provided at an inner lower portion of the insertion port 113. The delivery port 114 opens upward. The collection container 110 receives the waste powder discharged from the discharge port 91Ab of the transport pipe 91A through the delivery port 114.

A rotatable coupling member 115 is attached to a substantially center portion on the rear side surface (Y direction) of the collection container 110. A transport auger 116 extending into the collection container 110 is attached to the coupling member 115. The transport auger 116 rotates in accordance with the rotation of the coupling member 115 that is rotationally driven by a drive system (not illustrated) of the apparatus main body, so as to transport the collected waste powder toward the front side (the −Y direction) of the collection container 110.

In the image forming apparatus 1 including the powder collection device 100 configured as described above, the opening and closing body 93 is slid to switch between the plural collection containers 110 that collect the waste powder, so that a replacement frequency of the collection container 110 that becomes full can be reduced while an image forming operation is continued.

(3) Operation of Powder Collection Device

Figure 9:
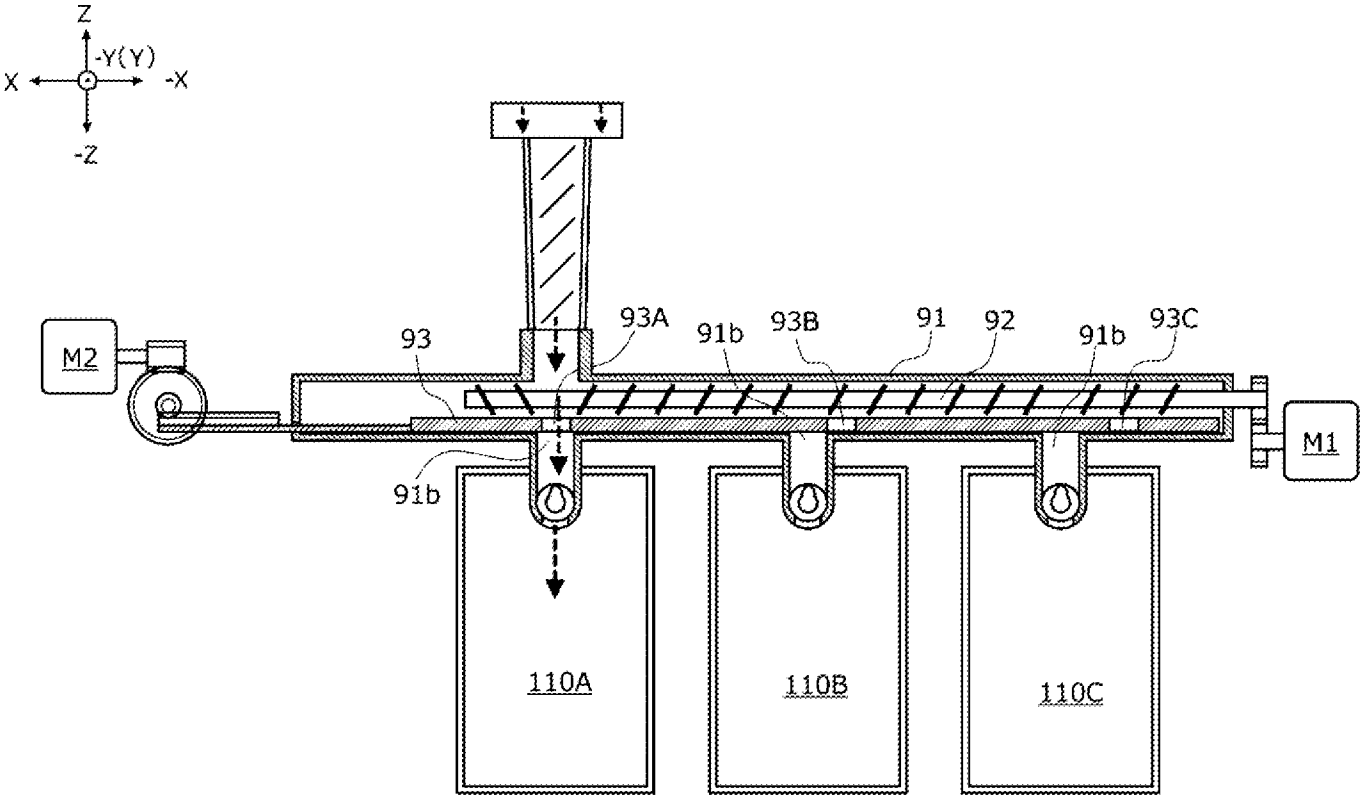
FIG. 9 illustrates a state in which the opening and closing body is located at an initial position and the waste powder is collected in a first collection container.
Figure 10:
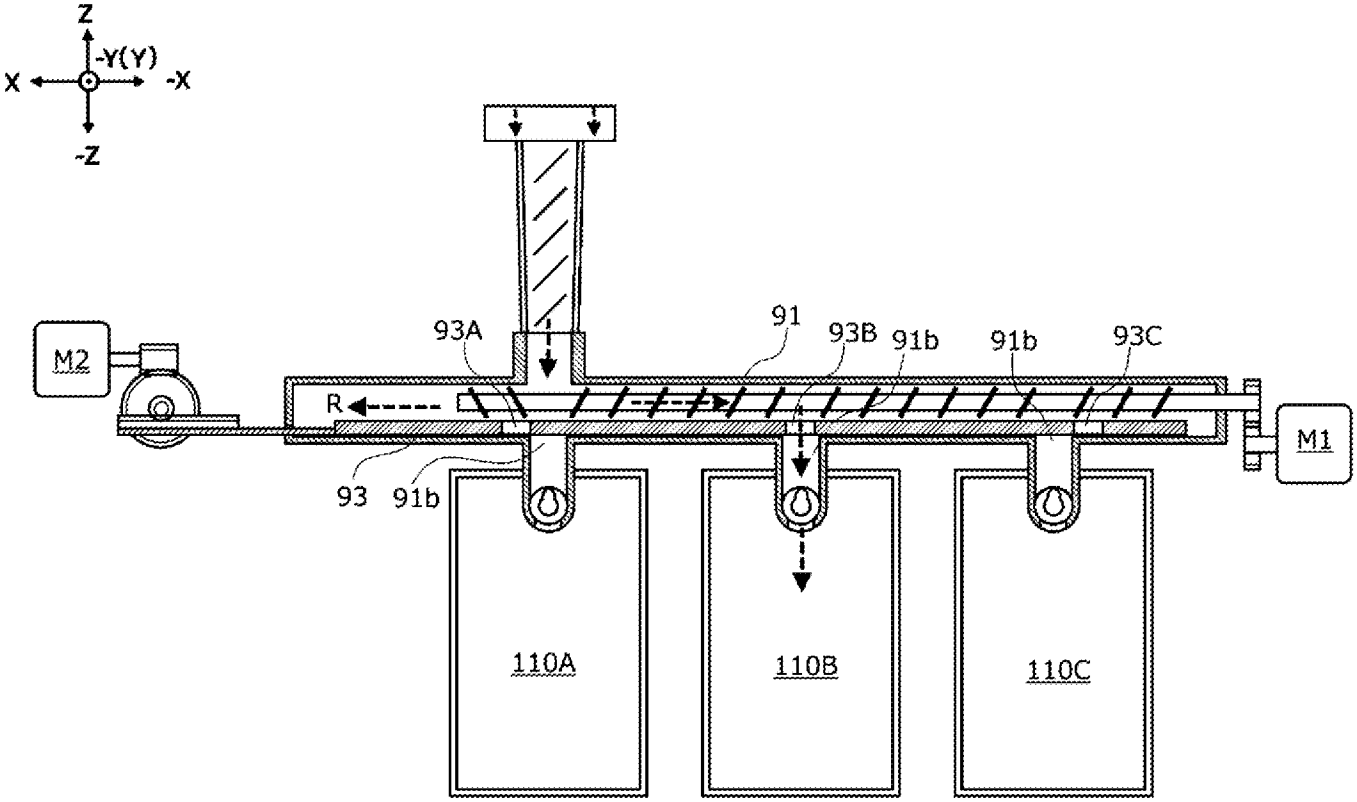
FIG. 10 is illustrates a state in which the opening and closing body slides such that the waste powder is collected in a second collection container.
Figure 11:
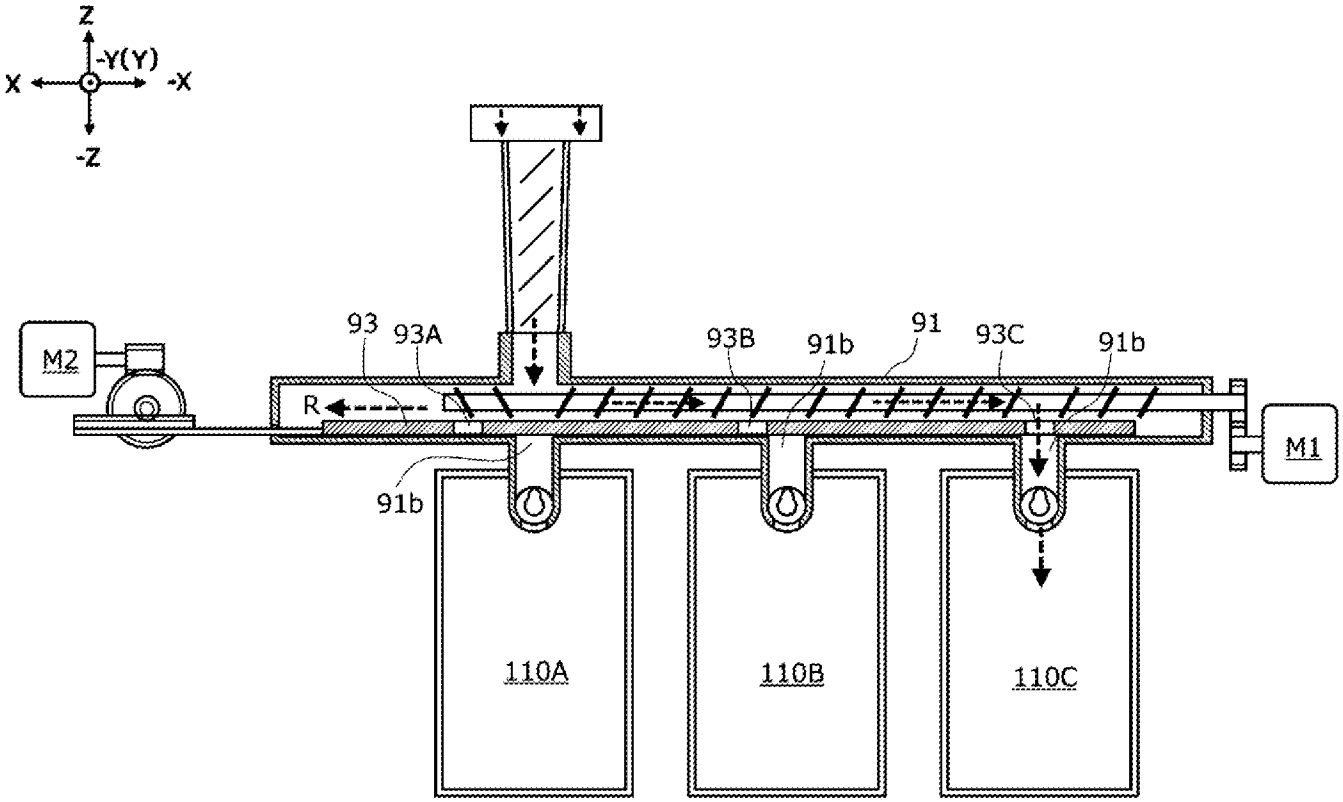
FIG. 11 illustrates a state in which the opening and closing body slides such that the waste powder is collected in a third collection container.

FIG. 9 illustrates a state in which the opening and closing body 93 is located at an initial position and the waste powder is collected in a first collection container 110A. FIG. 10 illustrates a state in which the opening and closing body 93 slides such that the waste powder is collected in a second collection container 110B. FIG. 11 illustrates a state in which the opening and closing body 93 slides such that the waste powder is collected in a third collection container 110C.

As illustrated in FIG. 9, the opening and closing body 93 is fitted into the inner surface of the transport conduit 91 so as to be slidable in the longitudinal direction of the transport conduit 91 in response to the rotation of a drive source M2. In the state where the opening and closing body 93 is located at the initial position, the opening 93A on the base end side in the sliding direction of the opening and closing body 93 and the discharge port 91*b* of the transport conduit 91 coincide with each other and the transport conduit 91 communicates with the first collection container 110A (that is the right (X direction) one among the collection containers 110). As a result, the waste powder is collected in the first collection container 110A (see arrows in FIG. 9).

Next, when the first collection container 110A becomes full with the waste powder, the drive source M2 rotates such that the opening and closing body 93 slides to a position where the opening 93B coincides with the discharge port 91*b* of the transport conduit 91 as illustrated in FIG. 10 (see an arrow R in FIG. 10). The openings 93B, 93C of the opening and closing body 93 are farther from the opening 93A on the base end side as the openings 93B, 93C are further away in the sliding direction. Therefore, when the center opening 93B slides to a position where the opening 93B coincides with the discharge port 91*b* of the transport conduit 91, none of the openings 91A, 93C coincides with any of the discharge ports 91*b* of the transport conduit 91.

As a result, the transport conduit 91 communicates with the second collection container 110B among the plural collection containers 110, and the waste powder is collected in the second collection container 110B (see arrows in FIG. 10).

Next, when the second collection container 110B becomes full with the waste powder, the drive source M2 rotates such that the opening and closing body 93 slides to a position where the opening 93C coincides with the discharge port 91*b* of the transport conduit 91 as illustrated in FIG. 11 (see an arrow R in FIG. 11). As a result, none of the openings 93A, 93B coincides with any of the discharge ports 91*b* of the transport conduit 91. The transport conduit 91 communicates with the third collection container 110C among the plural collection containers 110, and the waste powder is collected in the third collection container 110C (see arrows in FIG. 11).

As described above, the powder collection device 100 according to the present exemplary embodiment includes the plural collection containers 110 and the opening and closing body 93. The collection containers 110 are arranged on the same straight line. The opening and closing body 93 has the plural openings 93A, 93B, 93C. The opening and closing body 93 slides so as to cause the transport conduit 91 and the delivery ports 114 of the collection containers 110 to sequentially communicate with each other. As a result, when one of the collection containers 110 becomes full, the opening and closing body 93 is slid while the image forming apparatus 1 continues the image forming operation, so that it is possible to switch the transport destination of the waste powder to another collection container 110 and to continue the collection of the waste powder. The collection containers 110 are arranged side by side on the same straight line. Therefore, the plural collection containers 110 can be disposed without an increase of the space where the collection containers 110 are arranged in the image forming apparatus 1.

In the present exemplary embodiment, the three collection containers 110A, 110B, and 110C are arranged side by side along the transport direction of the waste powder. Alternatively, a large number of collection containers 110 may be arranged on the same straight line according to the internal space of the image forming apparatus 1. With this configuration, after the predetermined number of collection containers 110 are full, the collection containers 110 can be replaced at once. The replacement frequency of the collection containers 110 can be reduced.

In the present exemplary embodiment, the description has been made on the powder collection device 100 that collects, as the waste powder, the waste toner removed by the cleaning devices 33 and belt cleaning device 70 of the image forming apparatus 1 and the surplus developer discharged from the developing devices 14, and the like. Alternatively, the powder collected by the powder collection device 100 may be inorganic material powders or organic material powders for use in various technical fields such as an electronic field, an energy field, a medical field, and a food field, for example, powders of fine ceramics, metal materials, polymer materials, battery materials, electronic materials, composite materials, pharmaceutical materials, or food materials.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder collection device comprising:

a transport conduit configured to receive powder discharged from an image forming unit and transport the powder to discharge ports disposed on the transport conduit;

a plurality of collection containers arranged on a same straight line along the transport conduit, the collection containers being configured to accommodate the powder transported by the transport conduit; and an opening and closing body having a plurality of openings that is disposed within the transport conduit, the opening and closing body being configured to slide within the transport conduit and parallel to a longitudinal direction of the transport conduit so as to cause the transport conduit and the collection containers to sequentially communicate with each other by sequentially opening the discharge ports.

2. The powder collection device according to claim 1, wherein the openings include at least three openings, and a distance between adjacent openings differs depending on locations of the adjacent openings.

3. An image forming apparatus comprising:

an image forming unit configured to form a toner image; and the powder collection device according to claim 2, the powder collection device being configured to collect the powder collected from the image forming unit.

4. The powder collection device according to claim 1, wherein opening areas of the discharge ports are larger than opening areas of the openings.

5. An image forming apparatus comprising:

an image forming unit configured to form a toner image; and the powder collection device according to claim 4, the powder collection device being configured to collect the powder collected from the image forming unit.

6. An image forming apparatus comprising:

an image forming unit configured to form a toner image; and the powder collection device according to claim 1, the powder collection device being configured to collect the powder collected from the image forming unit.

7. The powder collection device according to claim 1, further comprising a spiral blade that is disposed within the transport conduit, the spiral blade being configured to rotate and transport the powder to the discharge ports.

8. The powder collection device according to claim 7, wherein the spiral blade is formed on and surrounds a rod, and the rod has a flat exterior surface without the spiral blade thereon in regions corresponding to the discharge ports.

9. The powder collection device according to claim 7, further comprising a first motor that drives the opening and closing body linearly, and a second motor that drives the spiral blade to rotate.

10. A powder collection device comprising:

a transport path configured to receive powder discharged from an image forming unit and transport the powder to discharge ports;

a plurality of collection containers arranged on the same straight line along the transport path, the collection containers being configured to accommodate the powder transported by the transport path; and an opening and closing body having a plurality of openings, the opening and closing body being configured to slide in the transport path so as to cause the transport path and the collection containers to sequentially communicate with each other, wherein the opening and closing body extends along the transport path, and the opening and closing body forms a part of an inner surface of the transport path.

11. The powder collection device according to claim 10, wherein the transport path comprises a transport unit having a spiral blade, the transport unit is configured to transport the powder by being rotationally driven, a surface of the opening and closing body forms the part of the inner surface of the transport path, and a gap between the surface of the opening and closing body and the transport unit is substantially constant.

12. The powder collection device according to claim 11, wherein no spiral blade is formed in regions corresponding to the discharge ports.

13. An image forming apparatus comprising:

an image forming unit configured to form a toner image; and the powder collection device according to claim 12, the powder collection device being configured to collect the powder collected from the image forming unit.

14. An image forming apparatus comprising:

an image forming unit configured to form a toner image; and the powder collection device according to claim 11, the powder collection device being configured to collect the powder collected from the image forming unit.

15. An image forming apparatus comprising:

an image forming unit configured to form a toner image; and the powder collection device according to claim 10, the powder collection device being configured to collect the powder collected from the image forming unit.

16. A powder collection device comprising:

transport means for receiving powder discharged from an image forming unit and transporting the powder to discharge ports disposed on the transport means;

a plurality of containing means arranged on a same straight line along the transport means, the plurality of containing means for accommodating the powder transported by the transport means; and opening and closing means having a plurality of openings and disposed within the transport means, the opening and closing means sliding within and parallel to a longitudinal direction of the transport means so as to cause the transport means and the containing means to sequentially communicate with each other by sequentially opening the discharge ports.

* * * * *